US006179023B1

(12) United States Patent
McGee

(10) Patent No.: US 6,179,023 B1
(45) Date of Patent: Jan. 30, 2001

(54) AIR BLOWER

(75) Inventor: Daniel W. McGee, Camarillo, CA (US)

(73) Assignee: Air-Jet, Inc, Petaluma, CA (US)

( * ) Notice: Under 35 U.S.C. 154(b), the term of this patent shall be extended for 0 days.

(21) Appl. No.: 09/156,993

(22) Filed: Sep. 18, 1998

(51) Int. Cl.[7] ..... B65B 1/04

(52) U.S. Cl. ..... 141/382; 141/231; 239/373; 239/154; 137/899.4

(58) Field of Search ..... 141/382, 231, 141/21, 19, 18, 3, 2, 197, 38; 137/899.4, 565.18, 224.5, 255, 256, 265, 266, 267, 226, 263, 572; 239/152, 153, 154, 337, 373, 99, 588, 581.1, 577, DIG. 21, 455; 224/904, 269, 267, 674; 15/405, 406; 128/205.22

(56) References Cited

U.S. PATENT DOCUMENTS

| | | | | |
|---|---|---|---|---|
| 2,906,263 | * | 9/1959 | Wolshin | 128/205.18 |
| 4,077,747 | * | 3/1978 | Burenga | 417/234 |
| 4,350,299 | * | 9/1982 | Stephenson et al. | 239/337 |
| 5,494,083 | * | 2/1996 | Elmore | 141/19 |
| 5,505,354 | * | 4/1996 | Hutton et al. | 224/196 |

* cited by examiner

*Primary Examiner*—Henry J. Recla
*Assistant Examiner*—Huyen Le
(74) *Attorney, Agent, or Firm*—Colin O. Abrahams

(57) ABSTRACT

An air blower comprises a first unit having means for producing compressed air and a reservoir for storing the compressed air and a second unit including a portable storage tank for holding compressed air, and means for releasing the compressed air from the storage tank. Means for charging are provided whereby compressed air in the reservoir of the first unit is transferred to the storage tank of the second unit.

18 Claims, 2 Drawing Sheets

AIR BLOWER

FIELD OF THE INVENTION

This invention relates to air or gas blowers and particularly air or gas blowers of the type used in yard cleanup. The air blower of the invention has particular application in yard and garden work, especially the blowing into piles of leaves, grass, dirt and other garden debris. The air blower may also be used for driving snow or moving water.

BACKGROUND OF THE INVENTION

Air blowers and leaf blowers for use in gathering backyard and garden debris are well-known. While several types of leaf blowers are available and in popular use, a typical leaf blower comprises a fuel powered internal combustion engine intended to drive a fan or other means, the fan being attached to a hose and handle whereby air is compressed and driven through the hose to the handle. Air exiting from the handle with force is used to drive the leaves and other garden debris into heaps facilitating leaf collection and disposal thereof.

The internal combustion engine, fuel tank, fan and air compressor in typical blowers would normally be mounted on a frame which can be worn of the back of the user. There is thus the convenience of a portable garden implement which can be easily transported for sweeping and gathering materials to be disposed.

Air blowers have applications not only with respect to collection of garden debris, but may be used in other contexts as well. For example, an air blower may also be used for removing now from roads or scattering a pool of water by blowing an air current into the pool.

U.S. Pat. No. 4,223,419 (Sato) describes a shoulder supported pneumatic sweeping apparatus. The sweeping apparatus is of the type that can be easily carried by means of a strap worn over the shoulder of the operator, and has a typical application in clearing the surface of a vast playground or a baseball field, removing snow from the roads, or scattering a pool of water by blowing an air current into it. The sweeping apparatus has a centrifugal fan located in a housing, which is driven by an engine. Upon rotation of the fan, an air current is produced and led to an outlet port, which in turn exits into a flexible pipe. An air ejection pipe conveys the air to the outside thereof. The exit or ejection pipe has an operating handle to facilitate the use of the ejecting pipe. The engine in this patent includes a starter, fuel tank, ignition plugs and the like and thus constitutes a standard or conventional internal combustion-type engine which has associated therewith high noise levels, and the emission of polluting hydrocarbon gases, nitrous oxide, carbon monoxide and other compositions.

U.S. Pat. No. 5,052,073 (Iida) discloses a back-pack type power working machine. This patent addresses an apparent problem in shoulder frame machines, which are relatively heavy and which generate vibration. The back-pack of Iida includes a carrying frame having a main frame section held against the back and side guard sections on each side of the main frame sections. The side guard sections are bent rearward and form a U-shape. A fan, driven by a gasoline engine connected to the fan, is located within the U-shaped frame and damping rubber members serve to prevent or reduce vibration of the fan and engine from being transmitted to the carrying frame and, ultimately, the operator. The working machine of Iida is, otherwise, very similar to the conventional type of sweeping apparatus as described in Sato above, and includes the internal combustion gasoline-driven engine for producing the stream of air. While the working machine is self-contained in that it provides the stream of air as well as the source for producing the stream of air, it is, nevertheless, still very noisy and produces exhaust emissions containing polluting and noxious gases.

U.S. Pat. No. 5,332,222 (Perry) shows a golf club including putting path cleaning means. The golf putter has a head, for striking the golf ball, and a shaft including a handgrip. Contained within the shaft is a compressed gas cartridge and a discharge nozzle, whereby gas can be discharged from the golf putter. Between the gas cartridge and the discharge nozzle, there is located a pipe for transmitting the compressed air and a valve assembly for controlling the flow. A trigger is provided which opens the otherwise closed valve to permit expulsion of air from the discharge nozzle. The air so discharged is used by the golfer to clear leaves or other objects and provide a debris-free path between the golf ball and the hole.

U.S. Pat. No. 1,932,137 (Jinkerson) shows a lawn cleaner including a platform mounted on wheels. Jinkerson uses compressed air discharged from an air compressor pump to an outlet tube, and a discharge nozzle. The compressor pump is driven by a water cooled motor, which is typically of the gasoline or internal combustion type. To the extent that Jinkerson has any modern applications, it is a self-contained unit, where the internal combustion engine produces substantial noise levels and pollutant emissions.

Other background art shows the use of compressed air guns, and can be seen in, for example, U.S. Pat. No. 2,016,113 Lambert) and U.S. Pat. No. 2,021,603 (Kelley).

SUMMARY OF THE INVENTION

According to one aspect of the invention, there is provided an air blower comprising: a first unit having means for producing compressed air and a reservoir for storing the compressed air; a second unit including a portable storage tank for holding compressed air, and means for releasing the compressed air from the storage tank; and means for charging whereby compressed air in the reservoir of the first unit is transferred to the storage tank of the second unit.

According to another aspect of the invention, there is provided a method of supplying an air stream to a predetermined location for moving debris, water and the like, the method comprising: providing a first unit having means for producing compressed air and a reservoir for storing the compressed air; providing a second unit including a portable storage tank for holding compressed air, and means for releasing the compressed air from the storage tank; and releasably connecting the first and second units whereby compressed air in the reservoir of the first unit is transferred to the storage tank of the second unit.

The invention is also, in another aspect, for a method of supplying an air stream to a predetermined location for moving debris, water and the like, the method comprising: producing a supply of compressed air at a first location; releasably connecting the supply of compressed air to a portable unit including a portable storage tank for holding compressed air; transferring at least a portion of the compressed air from the supply to the portable storage tank; and disconnecting the supply of compressed air and portable storage unit from each other and conveying the portable storage unit to the predetermined location.

In one aspect, this invention relates to an air blower device and system, whereby compressed air is produced and utilized in a manner wherein noise levels are substantially reduced, and the emission of noxious gases and pollutants may be effectively eliminated. In a further aspect, the invention comprises the production of compressed air, preferably by the use of electrical power, the transfer of the compressed air to a portable pack, whereby the portable pack can be used at a site where the compressed air is required to gather debris, spread water or snow, or such other use as the case may be.

In yet a further aspect, the invention uses valve assemblies for controlling the flow of compressed air within the system to ration and preserve the use of the compressed air, and therefore prolong or delay the need to recharge or refill the portable container with compressed air.

DETAILED DESCRIPTION OF THE PREFERRED EMBODIMENTS

Figure 1:
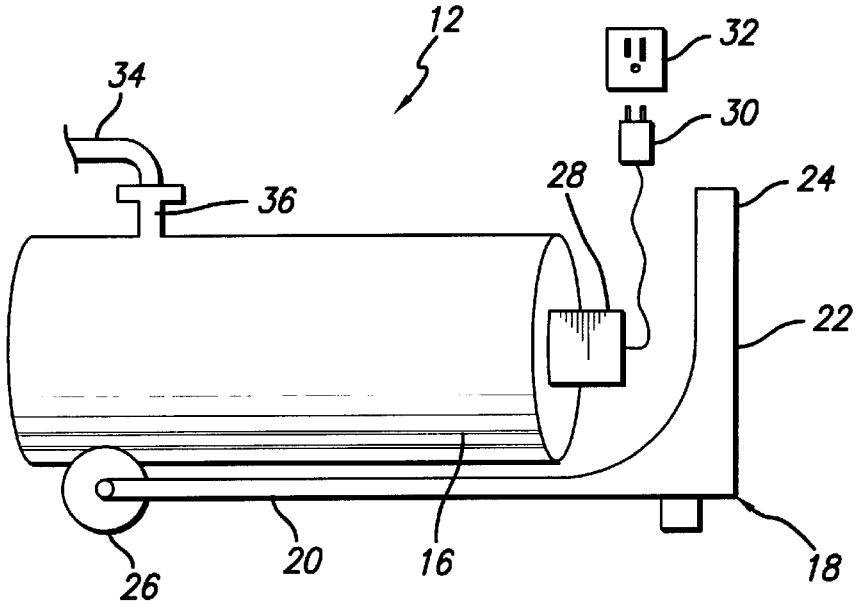
FIG. 1 is a side view of the air compressor and storage unit of the invention.

With reference to the attached drawings, there is shown an air blower of the invention which is comprised of a compressed air production and storage unit 12, and a portable compressed air carrying unit 14. The production and storage unit 12, as shown in FIG. 1 of the drawings, comprises a storage tank 16 mounted on a frame 18. The frame 18 includes a flatbed 20 for supporting the storage tank 16, and an upright section 22 ending with a handle 24. The flatbed portion 22 of the frame 18 terminates at the end opposite the handle, and has mounted near that end a pair of wheels 26 appropriately fixed on an axle in a conventional manner. The frame is thus designed to facilitate easy movement of the storage tank 16, so that the operator, holding onto the handle 24, can steer and position the unit 12 to the desired location.

The storage tank 16 has associated therewith an electric motor 28 connectable, through a plug 30, to a wall or other electrical outlet 32. When connected and operating, the electric motor 28 forces air into the storage tank 16, thereby producing compressed air under pressure. The compressed air is maintained in the storage tank 16 until required.

The compressed air production storage unit 12 includes an outlet 34 controlled by a valve 36 whereby compressed air stored within the unit 12 can be transferred to the portable compressed air carrying unit 14, as will be described more fully below.

Figure 2:
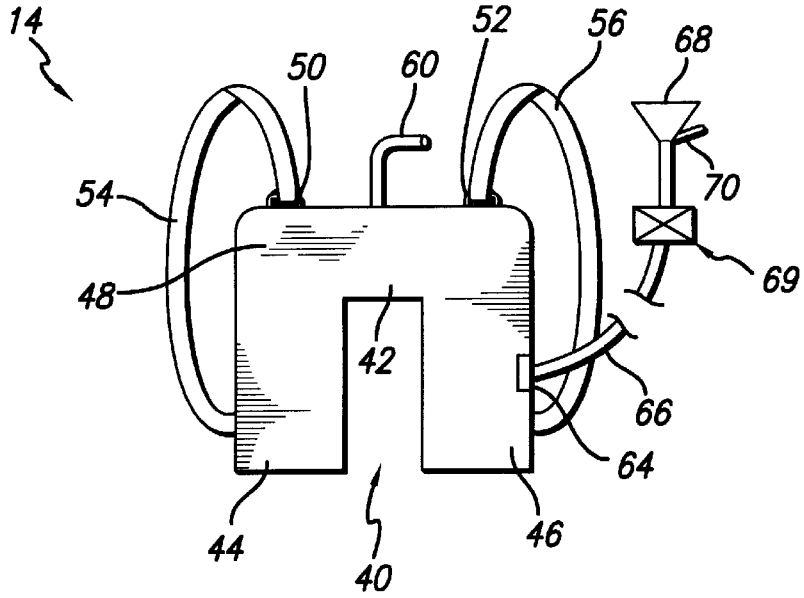
FIG. 2 is a back view of the portable compressed air carrying unit of the invention.

With reference to FIG. 2 of the drawings, there is shown a portable compressed air carrying unit 14 comprised mainly of a compressed air tank 40, which defines a chamber 62. While tanks of widely varying shapes and sizes may be used in accordance with this invention, the tank 40 shown in the embodiment of FIG. 2 is essentially an inverted U-shape, and comprises a horizontal portion 42, and two vertical legs 44 and 46 extending downwardly therefrom. The tank 40 is hollow, and may be comprised of metal, aluminum, light plastics material or any other suitable composition which is able to withstand the internal pressures of the compressed air within the tank 40.

On the upper surface 48 of the horizontal portion 42, there are located a pair of strap holders 50 and 52. The lower portions of the vertical legs 44 and 46 of the tank 40 also have strap holders, although these are not shown in FIG. 2 of the drawings. An adjustable strap 54 extends from the strap holder 50 to the strap holder on the vertical leg 44, while a strap 56 extends from the strap holder 52 to the strap holder on the vertical leg 46. The straps 54 and 56 are optimally designed so that they fit over the shoulders of the operator, and they hold the storage tank 40 comfortably and securely against the back of the operator.

The upper surface 48 of the horizontal portion 42 has extending therefrom an inlet tube 60. The inlet tube 60 is controlled by a valve (not shown) which permits air to be introduced to the tank 40 through the inlet tube 60 from an outside source, but prevents any airflow from the chamber 62 of the tank 40 from exiting through the inlet tube 60. In other words, the inlet tube 60 is controlled by a one-way valve permitting airflow into the chamber 62 of the tank 40 only.

The tank 40 has an outlet aperture 64 to which is attached a flexible outlet pipe 66 whereby compressed air within the tank 40 can be appropriately directed by the operator to an area requiring cleanup by the use of compressed air. The outlet pipe 66 terminates in a wand 68, and the flow of air from the pipe through the wand is controlled by a trigger 70 located adjacent, or forming part of, the wand. A wand 68 is preferably adjustable such that the air being discharged therefrom under pressure can be adjusted from a concentrated airstream to a diffuse fan-like discharge, or some configuration between these two extremes. Further details relating to the control of airflow and the nature of the discharge from the wand is discussed below with reference to other Figures.

Figure 5:
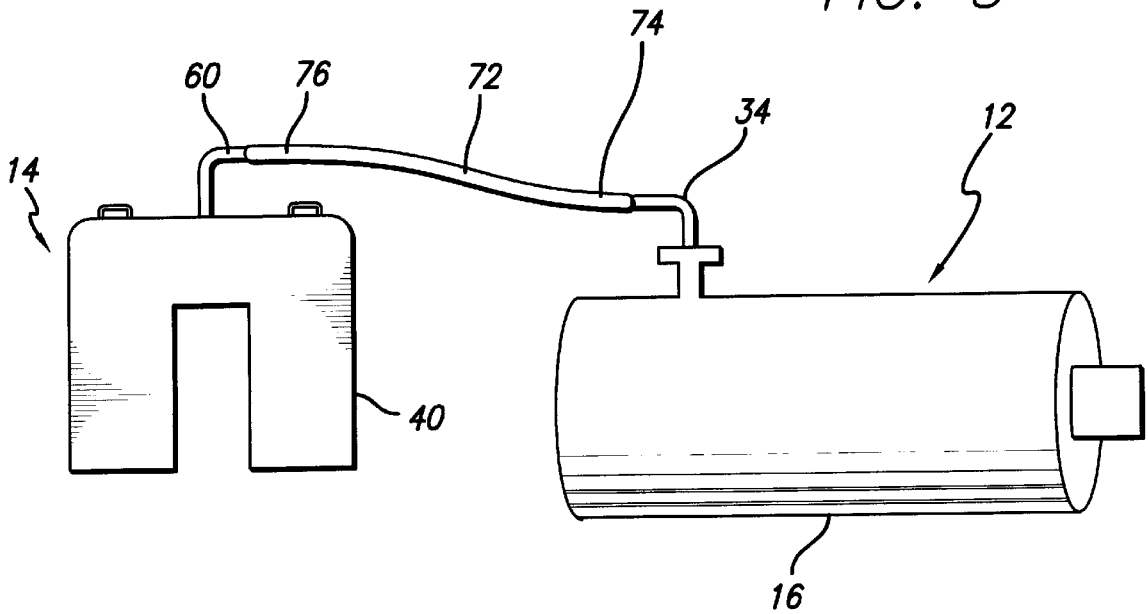
FIG. 5 is a diagrammatic representation showing the compressed air production and storage unit coupled with the portable compressed air carrying unit.

Reference is now made to FIG. 5 of the drawings which shows the compressed air production and storage unit 12 coupled to a portable compressed air carrying unit 14. The compressed air production and storage unit 12 will typically be a more cumbersome and heavier unit than the portable compressed air carrying unit 14. The production and storage unit 12 is designed so as to be mobile, but during operation will remain stationary and connected to a electric outlet. The electrically driven motor ensures a constant supply of air to the storage tank 16 which will therefore be available as a source of compressed air at all times. On the other hand, the portable compressed air carrying unit 14 is intended to be lightweight and very mobile, so that it can be attached to the back of an operator and travel with the operator to remote and different areas relative to the production and storage unit 12.

The portable compressed air carrying unit 14 is charged by connecting it to the production and storage unit 12 with a coupling line 72. A first end 74 of the coupling line 72 is connected, in any conventional manner, to the outlet 34 mounted on the storage tank 16. A second end 76 of the coupling line is connected, also using conventional techniques, to the inlet tube 60 mounted on the tank 40 of the portable compressed air carrying unit 14. When the carrying unit 14 is connected to the production and storage unit 12, the carrying unit 14 will typically be "empty" in the sense that the air pressure within the unit 14 will be the same as that outside of it. When the unit 12 and the unit 14 are connected by the coupling line 72, the valve 36 is activated to permit the flow of compressed air outwardly from the storage tank 16. Due to the substantial pressure differential between the air within the storage tank 16, and the air within the tank 40, there will be an immediate flow of air from the storage tank 16 to the tank 40 until a pressure equilibrium between the two is reached. Since the storage tank 16 would be significantly larger than the tank 40, and the electric motor 28 would be operative so as to provide a constant and recharging source of compressed air, the coupling of the units 12 and 14, and the release of the valve 36, will result in the charging of the tank 40 so that the chamber 62 will be filled with compressed air. The motor 28 is designed so as to constantly regenerate or refill storage tank 16 with compressed air until a threshold pressure has been met. Whenever the pressure drops below this threshold value, the electric motor 28 would be activated to restore the pressure within the storage tank 16 to the predetermined minimum.

When the tank 40 has been appropriately charged with compressed air, the valve 36 is deactivated to prevent further flow from the storage tank 16, and the unit 12 and unit 14 are separated by disconnecting the coupling line 72 at its first end 74 from the outlet 34, and at its second end 76 from the inlet tube 60. The carrying unit 14, duly charged with compressed air is then mounted by the straps 54 and 56 over the shoulders and back of the operator and transported to the area where cleanup or air under pressure is required.

With the chamber 62 filled with air under pressure, the air can be appropriately used and directed through the outlet pipe 66 to the wand 68. Thus, when the operator has reached a location where it would be appropriate to release air form the chamber 62, the wand 68 is directed to the point where compressed air is required for further operation.

Figure 3:
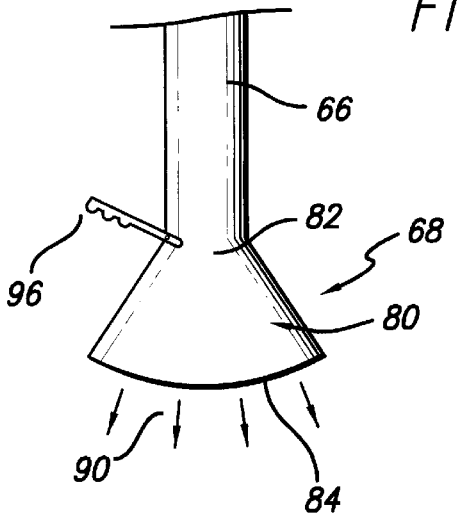
FIG. 3 is a detailed plan view of the wand outlet of the invention.
Figure 4:
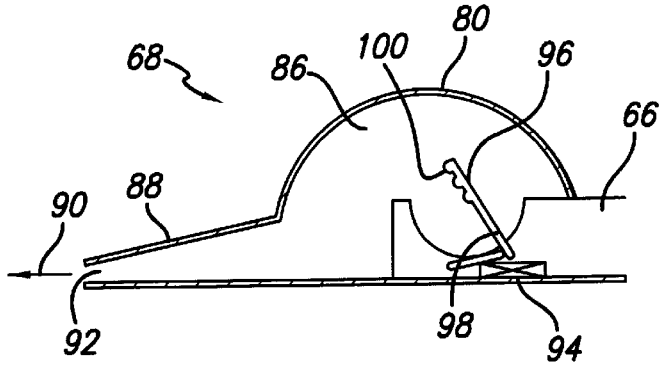
FIG. 4 is a detailed view of the hand operated trigger valve for controlling the flow of air from the portable compressed air carrying unit.

With reference to FIG. 3 of the drawings, there is shown a detailed view of the wand 68 attached to the flexible outlet pipe 66 which leads directly into the chamber 62 of the tank 40. The wand 68 comprises an essentially triangular shaped head 80, having a base 82 attached to the outlet pipe 66, and generally fanning out towards an air expulsion end 84. The head 80 comprises a housing defining a space 86 (see FIG. 4) through which air under pressure flows from the outlet pipe 66. The head 80 has a funnel shaped portion 88, which forms a narrowing to facilitate an increased velocity stream of air, designated by the reference numeral 90, emerging from the aperture 92 at the air expulsion end 84 of the head 80.

In normal circumstances, charged air within the chamber 62 extends through the outlet aperture 64, passes through the outlet pipe 66, and reaches the wand 68 where further flow of the air is controlled by a valve 94. The valve 94 is operated by a hand-held trigger 96 which is normally biased in a position so as to keep the valve 94 closed. Thus, unless and until the trigger 96 is pulled by manual activation to open the valve 94, compressed air in the outlet pipe 66 will be stopped at the valve 94. The trigger 96 is fixed by a pivot pin 98, about which it may rotate by the manual activation. Finger recesses 100 are conveniently provided in the trigger 96 for the comfort of the operator in order to obtain a secure grip on the trigger 96.

Since the trigger 96 is biased by means (not shown) which would normally urge the valve 94 into the closed position, merely releasing the trigger. 96 will cause the valve 94 to close, and stop further flow of compressed air through the wand 68.

The air expulsion end 84 of the wand 68 may be suitably shaped so that air can be fanned out as it emerges from the aperture 92, or it can be shaped so as to discharge a concentrated stream of air. The air expulsion end 84 and/or the funnel-shaped portion 88 may be adjustable on a single wand so that the nature of the air stream emerging through the aperture 92 can be varied on a particular wand to suit the circumstances and conditions.

It will be appreciated that optimal utilization of available compressed air within the chamber 62 of the tank 40 is essential in order to obtain maximum use of the air blower. It is desirable that the operator of the portable compressed air carrying unit 14 should have to make as few trips as possible back to the compressed air production and storage unit 12 to recharge the tank 40 with compressed air. In order to maximize the effective use of the compressed air within the tank 40, the invention also uses compressed air conservation valves to modulate the amount of air being discharged from the tank 40. Preferably, the valve comprises a pulse-modulation valve activated by the stream of compressed air. The pulse-modulation valve, which may be located in the flexible outlet pipe 66 or wand 68, preferably has the effect of turning on and off in rapid succession the airstream flowing between the tank 40 and the wand 68. For example, the pulse-modulation valve 69, preferably located in the outlet pipe 66, may consist of a wheel which turns in response to the flow of air through the outlet pipe 66. Thus, activation of the trigger handle 96 starts the flow of the air stream from the tank 40 to the wand 68, and a wheel valve located in its path would spin at a rapid pace by virtue of the air stream passing therethrough. The wheel valve is structured such that, as it turns, it opens and closes the flow of compressed air through the outlet pipe 66, thus providing a rapid pulsed effect. Over a given time, considerably less air is therefore discharged from the tank 40, thereby increasing the amount of time it takes to deplete the tank of compressed air. The net effect is preservation of gas pressure in the tank, making its supply last longer, and reducing the number of trips which an operator need make to the compressed air production and storage unit 12 in order to recharge the tank 40.

While an electric motor of the type described with respect to the attached figures is preferable, any type of motor or engine for driving the compressor to produce compressed air would be suitable. Moreover, the invention is not limited to any type of compressor, and any appropriate compressor will serve the purpose of the invention. While an internal combustion engine is feasible for driving the compressor to produce the compressed air, an electric engine is preferable for the reason that it will substantially reduce noise levels in the production of compressed air, and essentially obviate the emission of any pollutants. Since one of the objectives of the invention is to provide an air blower with reduced noise levels and lower pollution, an electrical engine for driving the compressor is preferred.

The air is transferred from the compressor to the main storage tank 16 through an appropriate hose, and any suitable hose will be within the scope of the invention. Moreover, conventional type connections between the hose, compressor and main storage tank 16, with, where necessary, the accompanying seals, clamping and valve systems, would be appropriate. The valve systems would, of course, ensure that air from the compressor flows into the storage tank 16 and that compressed air stored therein is not able to escape back in the direction of the compressor through the hose.

In FIG. 1 of the drawings, the main storage tank 16 is shown to be an essentially cylindrical container, but the container may be of any desired shape and configuration to fit the circumstances, and is not limited to the cylindrical shape.

Preferably, the valves on the compressed air production and storage unit 12 and portable compressed air carrying unit 14 to which the coupling line 72 is connected are of the quick-connector type, and the connection of the coupling line 72 to the outlet 34 on the storage tank 16 may in fact activate and open the valve in order to permit the flow of air from the main storage tank 16 to the chamber 62 in the tank 40. A valve in this context may be of the type comprising a ball-bearing in a groove, which is a one-way flow valve permitting the flow of compressed air from the tank 16 to the tank 40. Preferably, the coupling line 72 connects to the inlet tube 60 at its second end 76 also by a quick-connect procedure such that the connection of the coupling line 72 to a valve in the inlet tube 60 opens the valve to permit the flow of air from the tank 16 to the tank 40. The portable tank is charged after the connection by the flow of air from a high pressure container, which is the tank 16, to a lower pressure in the tank 14, the flow direction of compressed air being determined by the pressure differential between these two tanks.

The tank 40 in FIG. 2 is shown to be of an inverted U-shaped structure but, once more, the tank may be of any convenient and desired shape to enable it to be conveniently and comfortably transported, usually on the back of the operator. The flexible outlet pipe 66 extending from the tank, and in communication with the chamber 62, permits the flow of air to do the work, with the flow of air being controlled by the valve 94, as well as the wheel valve 69 which provides the pulsed modulation effect, located preferably within the outlet pipe 66.

The conservation of compressed air, and the maximization of use of compressed air available within the tank 40 is controlled by the two valves 69, namely, the pulse modulation valve and the squeeze trigger. The squeeze trigger valve is manually turned on and off by the operator, so that compressed air will be allowed to escape through the wand 68 only when the wand is in the desired position, and air is otherwise prevented from leaving the system.

The pulse modulation valve 69, which allows the air to escape in bursts, will only come into operation when the hand-activated squeeze trigger is pulled by the operator. The pulse modulation valve 69 would be upstream of the squeeze trigger in the hose line, and is preferably a wheel spinning, at the same time turning the air on and off at a rapid pace to give the pulsed effect. The effect of both of these valves is to ensure that the available compressed air is conserved insofar as possible, and only released when the wand is in a position to usefully apply the released compressed air for blowing leaves, water etc.

The air blower of the invention has definite advantages over the prior art. Most importantly, the absence of an internal combustion engine essentially eliminates the high noise levels produced by air blowers of the prior art. The only noise emissions from the air blower of the invention will be the hiss of the escaping air, and no more. Moreover, since the motor driving the compressor is preferably an electric one, there is no burning of hydrocarbon fuels with the concomitant emissions of pollutant gases. The two-unit system of the invention clearly allows for this reduction in noise and pollution, since the carrying unit 14 essentially comprises only a tank which operates as a reservoir for compressed air to be used at the location where cleanup is desired. There are no motors, compressors or other machinery attached to this unit 14. The compressed air is produced by the unit 12, which uses a relatively silent electric motor to drive the compressor and to produce and store the compressed air.

The two components of the invention, namely, the production and storage unit 12 and the portable compressed air carrying unit 14, are mobile, but to different extents according to their functions. The production and storage unit 12, while heavier, is mounted on a frame which can be wheeled from, for example, a storage area or a truck to a position adjacent an electric outlet. Once it is situated adjacent an electric outlet, no further movement is required, until it needs to be stored once more, or placed on a truck for further transport. On the other hand, the carrying unit 14 is extremely light and easy to carry, since it has no motor, compressor or other parts which affect the portability of the unit. It is simply a tank which has the capacity for easy recharge from the main storage unit 12. As such, it can be worn by an operator easily and comfortably, and the weight thereof can be kept to a minimum to reduce fatigue of the operator. Unpleasant and unhealthy vibrations are absent, further enhancing its comfort levels.

There are also situations where the production and storage unit 12 may be permanently located, for example near a very large field which is frequently cleared, so that movement and transport of this unit will be unnecessary. The production and storage unit 12, whether located in a single area only, or whether transported form one location to another, may, of course, serve any number of compressed air carrying units 14 so that several operators with such carrying units 14 may return to the production and storage unit 12 for recharging the tank 40 with compressed air.

The invention is not limited to the details and specific embodiments described herein.

What is claimed is:

1. An air blower comprising:

a first unit having means for producing compressed air and a reservoir for storing the compressed air;

a second unit including a portable storage tank for holding compressed air, and means for releasing the compressed air from the storage tank, the means for releasing including a pulse modulation valve which is activated by a stream of compressed air flowing through the valve such that the pulse modulation valve interrupts the flow of compressed air to produce a series of rapid air pulses; and means for charging whereby compressed air in the reservoir of the first unit is transferred to the storage tank of the second unit.

2. An air blower as claimed in claim 1 wherein the means for producing compressed air is a compressor, the compressor being powered by a motor.

3. An air blower as claimed in claim 2 wherein the motor is an electric motor.

4. An air blower as claimed in claim 2 wherein the motor is an internal combustion engine.

5. An air blower as claimed in claim 1 wherein the first unit further comprises a frame mounted on wheels and including a handle, with the reservoir being mounted on the frame.

6. An air blower as claimed in claim 1 wherein the reservoir is a substantially cylindrical container with closed ends.

7. An air blower as claimed in claim 1 wherein the means for charging comprises a valve controlled outlet on the reservoir, and a valve controlled inlet on the storage tank.

8. An air blower as claimed in claim 7 wherein the means for charging further comprises a coupling line between the outlet of the reservoir and the inlet of the storage tank whereby compressed air is permitted to flow from the reservoir to the storage tank.

9. An air blower as claimed in claim 1 wherein the second unit comprises a pair of straps to facilitate mounting of the second unit on an operator.

10. An air blower as claimed in claim 1 wherein the means for releasing the compressed air from the storage tank comprises an outlet pipe extending from the storage tank and end means on the outlet pipe.

11. An air blower as claimed in claim 10 wherein the end means is a wand through which the compressed air is released from the air blower, the wand being shaped so that an airstream emerging from the wand has a predetermined shape.

12. An air blower as claimed in claim 11 wherein the wand includes adjustable means so that the airstream can be adjusted according to external requirements.

13. An air blower as claimed in claim 1 wherein the means for releasing includes a manually activated valve normally biased towards the closed position, the manually activated valve including a trigger for use by an operator in opening the valve.

14. An air blower as claimed in claim 1 wherein the pulse-modulation valve comprises a wheeled valve in the path of the stream of compressed air, the stream of compressed air rotating the wheel which in turn results in the opening and closing of a passage of the stream of air to produce the pulsed modulation effect.

15. An air blower comprising:

a first unit having means for producing compressed air;

a second unit having a portable storage tank for holding compressed air, and means for releasing the compressed air from the storage tank, the means for releasing including a pulse modulation valve which is activated by a stream of compressed air flowing through the valve such that the pulse modulation valve interrupts the flow of compressed air to produce a series of rapid air pulses; and means for charging whereby compressed air in the first unit is transferred to the storage tank of the second unit.

16. A method of supplying an air stream to a location, the method comprising:

providing a first unit having means for producing compressed air and a reservoir for storing compressed air;

providing a second unit including a portable storage tank for holding compressed air, means for releasing the compressed air from the storage tank including activating a pulse modulation valve by a stream of compressed air flowing through the valve such that the pulse modulation valve interrupts the flow of compressed air to produce a series of rapid air pulses; and releasably connecting the first and second units for charging whereby compressed air in the reservoir of the first unit is transferred to the storage tank of the second unit.

17. A method of supplying an air stream to a predetermined location for moving debris, and water, the method comprising:

producing a supply of compressed air at a first location;

releasably connecting the supply of compressed air to a portable unit including a portable storage tank for holding compressed air and a means for releasing including a pulse modulation valve which is activated by a stream of compressed air flowing through the valve such that the pulse modulation valve interupts the flow of compressed air to produce a series of rapid air pulses;

transferring at least a portion of the compressed air from the supply to the portable storage tank; and disconnecting the supply of compressed air and portable storage unit from each other and conveying the portable storage unit to the predetermined location.

18. A method as claimed in claim 17 further comprising storing said compressed air supply in a reservoir.

* * * * *